US006769947B1

(12) United States Patent
Kuenzler et al.

(10) Patent No.: US 6,769,947 B1
(45) Date of Patent: Aug. 3, 2004

(54) METHOD FOR MANUFACTURING A LAMP ELECTRODE

(75) Inventors: Glenn H. Kuenzler, Macedonia, OH (US); Edward J. Balaschak, Avon, OH (US)

(73) Assignee: General Electric Company, Schenectady, NY (US)

( * ) Notice: Subject to any disclaimer, the term of this patent is extended or adjusted under 35 U.S.C. 154(b) by 539 days.

(21) Appl. No.: 09/604,628

(22) Filed: Jun. 27, 2000

(51) Int. Cl.[7] ..... H01J 9/00; H01J 9/02

(52) U.S. Cl. ..... 445/46; 445/35; 445/29; 445/52; 445/66; 140/71.5; 140/71.6

(58) Field of Search ..... 445/46, 48, 49, 445/52; 313/628, 631; 140/111, 112, 71.5, 71.6

(56) References Cited

U.S. PATENT DOCUMENTS 2,687,489 A * 8/1954 Anderson et al. ..... 313/628
3,132,409 A * 5/1964 Freeman ..... 313/628
3,259,969 A * 7/1966 Tessmann ..... 228/125
4,105,908 A 8/1978 Harding et al. ..... 313/631
4,275,329 A 6/1981 Fridrich et al. ..... 313/628
5,424,609 A * 6/1995 Geven et al. ..... 313/634
5,557,169 A * 9/1996 Van Lierop et al. ..... 313/623
5,917,983 A 6/1999 Page et al. ..... 385/134

* cited by examiner

*Primary Examiner*—Nimeshkumar D. Patel
*Assistant Examiner*—Mariceli Santiago
(74) *Attorney, Agent, or Firm*—Fay, Sharpe, Fagan, Minnich & McKee, LLP

(57) ABSTRACT

An electrode E is manufactured through a series of steps that lend themselves to implementation on a machine tool. Electrode components 100, 158, 190 are joined or welded to other electrode components 62, 100, 158 and then cut to length from a continuous supply of material. Windings of a coil 170 with a relatively narrow inner diameter 174 are opened in a rotating step so that the coil can tightly engage a component 158 having a larger outer diameter 178.

23 Claims, 5 Drawing Sheets

METHOD FOR MANUFACTURING A LAMP ELECTRODE

BACKGROUND OF THE INVENTION

1. Field of the Invention

The invention pertains to the art of manufacturing processes. It finds application in the manufacture of electrodes for lamps and in particular in the manufacture of electrodes for ceramic metal halide lamps.

2. Discussion of the Art

A current method of manufacturing electrodes for ceramic metal-halide lamps uses fixtures with precision v-slots and spring clamps to align component wire axes. These fixtures are difficult to manufacture with a level of precision needed to meet product requirements. Furthermore, each product type requires a custom-built fixture to handle different wire diameters. Additionally, each component of the electrode must be pre-cut to length, singulated, and fed into the fixture from the side, contributing to the complexity of a feeding system.

Another problem with the existing process is the manufacture and handling of electrode components, namely electrode tips. It is believed that these tips are manufactured by hand. The tips are expensive. Furthermore, new low-wattage products will require even smaller electrodes. Current manufacturing techniques appear unable to accommodate the requisite smaller size.

Once the tips are manufactured, they must be separated and delivered to an assembly fixture. The current handling process involves bowl feeding electrode tips, molybdenum overwinds and niobium wire shanks into vibratory tracks. The tracks deliver the electrode components or parts to an escapement where they are removed by a vacuum pick-and-place device. The pick-and-place device orients and delivers the parts into assembly fixtures where they are welded together. This technique works reasonably well for tips with shank diameters larger than 0.010"; however, it is increasingly more difficult to separate, pickup, and orient the tips in an assembly fixture as the tips get smaller.

To date, available lamp electrode manufacturing techniques are unable to accommodate the reduced size of electrodes needed for low wattage lamps. Additionally, available manufacturing techniques are too expensive to be useful in a high-volume manufacturing environment necessary to make manufacture and sale of low wattage lamps practical. Thus, the need exists to provide a method for manufacturing electrodes for lamps that is fast, inexpensive, and amenable to high production volumes.

BRIEF SUMMARY OF THE INVENTION

An exemplary method for making a lamp electrode is suitable for automation and adaptable for use on a machine tool. The method comprises the steps of cutting a first material having a first end, to a desired length, thereby defining a second end, welding a first end of a second material to the second end of the first material, cutting the second material to define a second end of the second material, welding a first end of a third material to the second end of the second material, cutting the third material to define a second end of the third material, and securing a coil to the second end of the third material.

One advantage of the present invention is that it can be implemented on a machine tool.

Another advantage of the present invention is that it allows for the manufacture of electrode components with very low unit-to-unit dimensional variation.

A further advantage of the present invention is that it provides for precise electrode component alignment while eliminating the need for custom fixtures.

Still another advantage of the present invention is that it provides for the rapid and inexpensive manufacture of electrodes.

Another advantage of the present invention is that it provides for the manufacture of extremely small electrodes.

DETAILED DESCRIPTION OF THE INVENTION

The present invention relates to a method for manufacturing an electrode. A conventional electrode used in a ceramic metal halide lamp, for example, includes a tungsten tip (a tungsten shank having a tungsten coil), a molybdenum overwind, and a niobium wire joined in end-to-end fashion. The electrode can be manufactured in numerous ways. The preferred embodiment uses a machine tool to carry out various steps. Machine tools are well suited to carrying out steps of the present invention because they can align parts extremely precisely and with a high degree of repeatability. Machine tools can also be loaded with bulk supplies of raw materials, such as, for example, long shanks and/or spools of wire. An example of an appropriate machine tool for performing steps of the present invention is a Swiss turning machine. Swiss turning machines are normally used for machining of small metal parts. Such a machine is capable of performing operations such as those required by the present invention. The invention will be described in relation to its implementation on such a machine tool.

Figure 1:
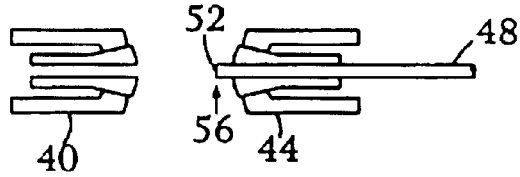
FIGS. 1–24 are elevational views of sequential steps of making a lamp electrode, where collets are shown in longitudinal cross-section for ease of illustrating components and subassemblies of the lamp electrode.

Referring now to FIG. 1, a first 40 and a second 44 collet, which can be part of a machine tool (not shown), are positioned in an axially aligned, facing relation. The second collet 44 is associated with a supply of a first material 48, for example, niobium wire used to make a lamp electrode. A leading or first end 52 of the first material 48 is presented by the second collet and is located at a reference point 56. The first end 52 is positioned at the reference point 56 by conventional means. Such conventional means include sensing the position of the end (using optical, electrical or mechanical means) or by cutting the end at a known location. Subsequent material and collet movements are based on the reference position.

Figure 2:
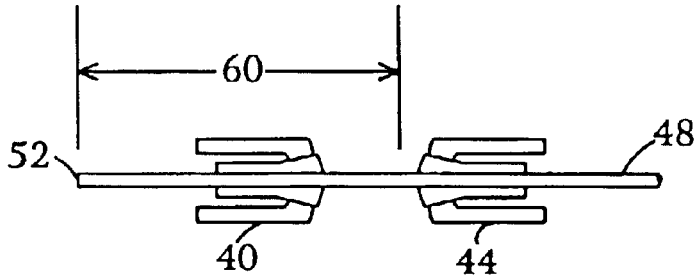

Subsequent to referencing, the first material 48 is advanced or indexed a predetermined distance 60 into the first collet 40 (FIG. 2). The predetermined distance 60 is a function of a desired length for a first material component of the electrode.

Figure 3:
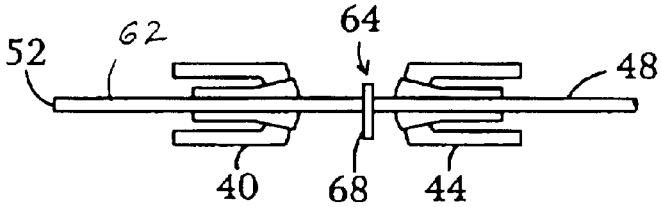

The first material 48 is cut at a predetermined location 64 FIG. 3) which is also a function of the desired length for the first component 62 of the electrode. Cutting is preferably done with a diamond saw 68. Other cutting techniques can be used, although using the diamond saw 68 is preferred since it eliminates the need for secondary cleanup and polishing operations.

Figure 4:
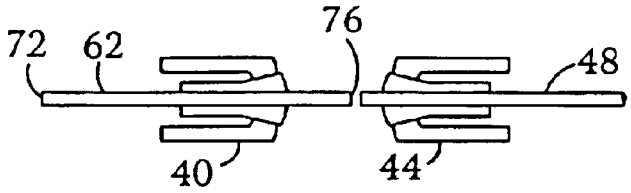
Figure 5:
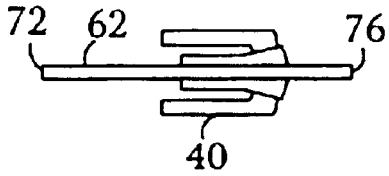

Referring now to FIGS. 4 and 5, the first collet 40 holds the first material component 62, and the second collet 44 is indexed out of position or removed from its facing relation with the first collet. Thus, the first material, or niobium wire, is removed in preparation for the next component or part of the electrode. The first component 62 is clamped between its first and second ends 72, 76 in the first collet.

Figure 6:
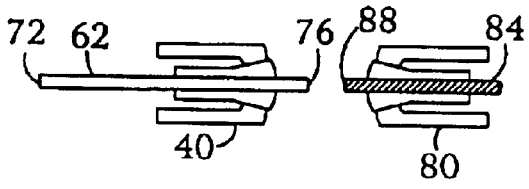

As exemplified in FIG. 6, a third collet 80 is indexed into position replacing the second collet. Of course it will be understood that the third collet may be the same, second collet illustrated in FIGS. 1–4 that now carries a supply of a second material 84, such as, for example, molybdenum overwind used in the lamp electrode. The second material 84 has a first end 88 that is presented by the third collet and is referenced in a manner similar to that described with reference to FIG. 1.

Figure 7:
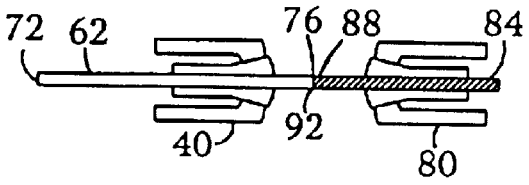

The second material 84 is advanced or indexed as depicted in FIG. 7 so that a first end 88 of the second material is adjacent to the second end 76 of the first material. The first end 88 of the second material 84 is suitably positioned for joining the second material 84 to the first material component 62. Preferably the materials are joined together by welding, forming a first weld 92. However, other joining techniques can be used, such as, for example, crimping or bonding in environments other than forming a lamp electrode.

Figure 8:
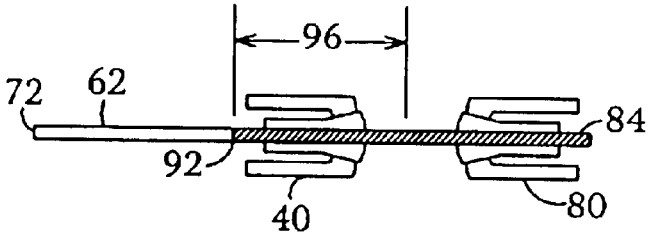

FIG. 8 shows further advancing or indexing of the joined first material component 62 and the second material 84 through the first collet 40. This subassembly is advanced a preselected distance 96 as a function of a desired length of the electrode.

Figure 9:
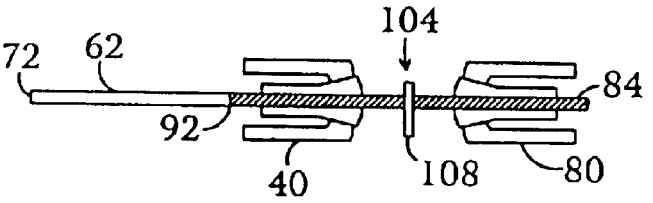

Once advanced the preselected distance, the second material 84 is cut at a second material cutting position 104 (FIG. 9) between the collets 40, 80. While the first collet 40 preferably holds a portion of the second material 84 during the cutting operation, it is understood that the collet 40 could alternatively hold a portion of the first material component 62, i.e., it is important that the subassembly is adequately supported while it is cut.

Figure 10:
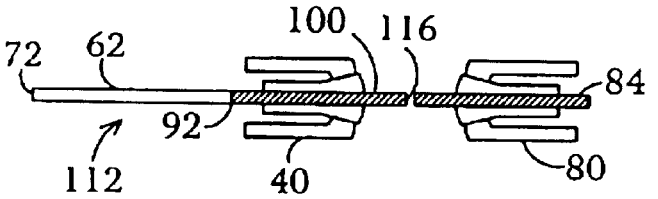
Figure 11:
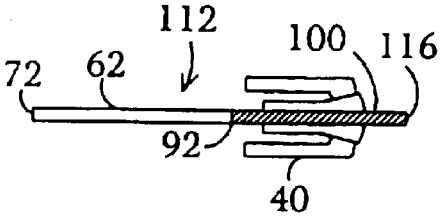

Upon completing the cutting operation, a first electrode sub-assembly 112 is defined and held in the first collet 40. A second end 116 of the second material component 100 is defined as a result (FIG. 10). The remainder of the second material is removed when the third collet 80 is indexed out of the way to make way for another collet (FIG. 11).

Figure 12:
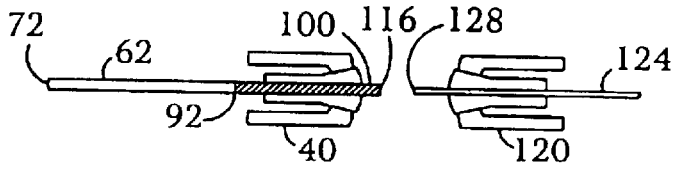
Figure 13:
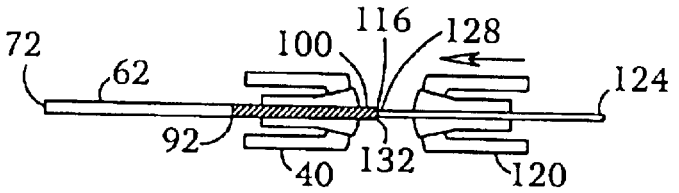

A fourth collet 120 is next indexed into position to replace the third collet 80. The fourth collet 120 carries a supply of a third material 124, such as tungsten shank wire that is used to make the lamp electrode. A first end 128 of the wire 124 is referenced in a manner similar to that described above with respect to FIG. 1. The first end 128 of the third material is advanced or indexed toward the second end 116 of the second material component 100 as illustrated in FIG. 13. Although a comparison of FIGS. 12 and 13 illustrates that the fourth collet is axially advanced toward the first collet, it will be appreciated that the third material can alternately be advanced by simply pushing the third material through fourth collet. In any event, the first end 128 of the third material 124 is brought into abutting engagement with the second end 116 of the second material component 100. This suitably positions the component ends for joining, again, by forming a second weld 132. While the figure shows the first collet 40 holding a portion of the second material component 100, it is understood that it could be holding a portion of the first material component 62.

Figure 14:
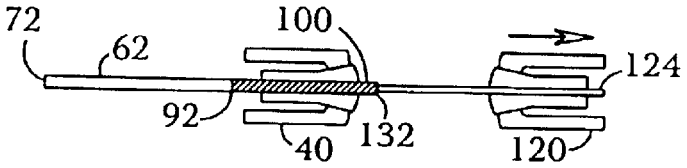
Figure 15:
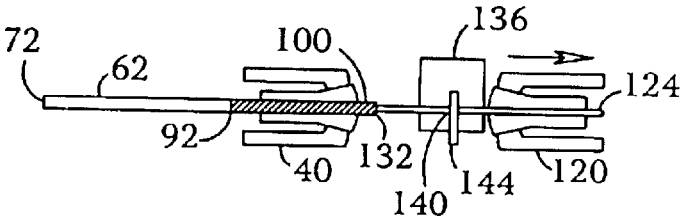
Figure 16:
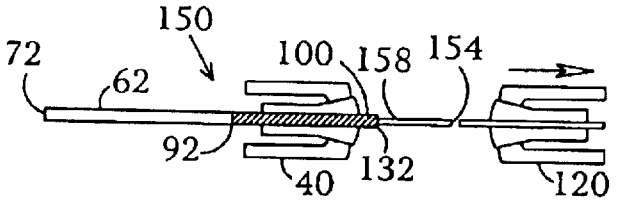
Figure 17:
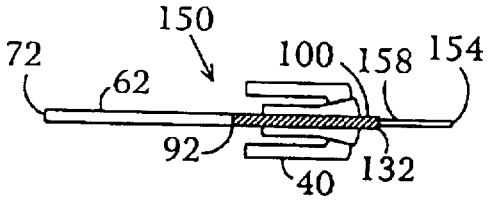

Referring to FIG. 14, the fourth collet 120 opens and moves axially over the third material (rightwardly as shown). This allows a guide device 136, for example, a conventional clam-shell gripper with precision ground surfaces, to be positioned around the third material 124 and provide support while the third material 124 is cut at a third material cut position 140 (FIG. 15). Again, the cut position 140 is a function of a desired length of the completed electrode (FIG. 16). The first collet 40 holds a portion of the second material component 100, although it is understood that the first collet could hold a portion of the first material component 62 and/or a portion of the third material 124.

A second electrode sub-assembly 150 is defined and held in the first collet 40 once the third material is cut at a second end 154. The fourth collet 120 is then moved away for additional manufacture of the electrode.

Figure 18:
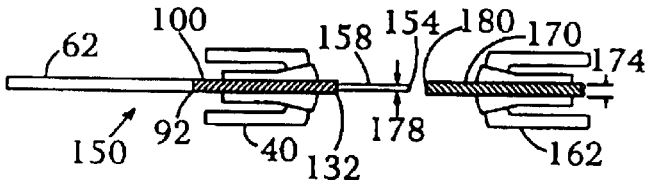
Figure 19:
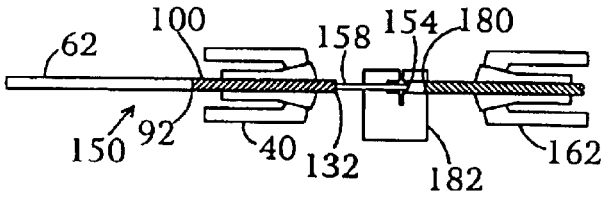

In FIG. 18, a fifth collet 162 is moved into facing relation with the first collet. The fifth collet carries a supply of a fourth material, in the form of a tungsten coil 170, having an inner diameter slightly smaller than an outer diameter 178 of the third material component 158. The coil 170 has a first end 180 that is held at a preselected location in the fifth collet.

A guide 182 is brought between the first and fifth collets to ensure axial alignment of mating portions of the third material component 158 and the coil 170. If a guide is not used, it is beneficial to grip the third material component and the coil adjacent their respective ends 154, 180 to provide tight positional control and axial alignment.

Figure 20:
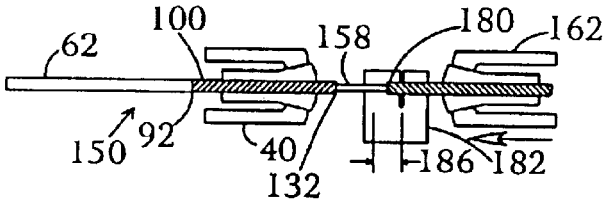
Figure 21:
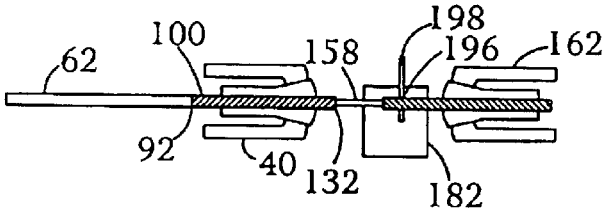

FIG. 20 illustrates axial advancement of the coil 170 toward the second end 154 of the third material component. The coil is joined or secured to the second end 154 of the third material component 158 by pushing it over the third material component 158 a predetermined engagement distance 186. The engagement distance 186 is a function of a desired final coil length of an electrode tip component 190 (see FIG. 22) of the electrode 38.

After the coil is press fit onto the second end of third material component 158, the coil 170 is cut at a coil cutting position 196 between the first collet 40 and the fifth collet 162. The coil cutting position is determined by the desired length of the electrode tip 190 on the end of the electrode. Additionally, it may be beneficial to cut part of the second end 154 of the third material component 158 so the third material component 158 can act as a support for the coil 170 during the cutting process. The guide 182 also acts as a support during the cutting process.

Figure 22:
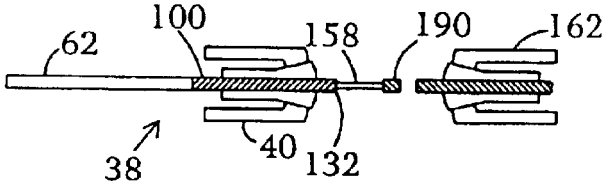
Figure 23:
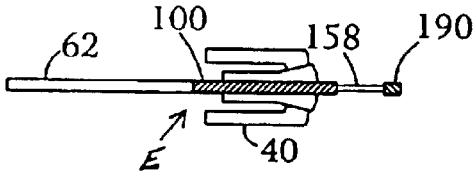
Figure 24:
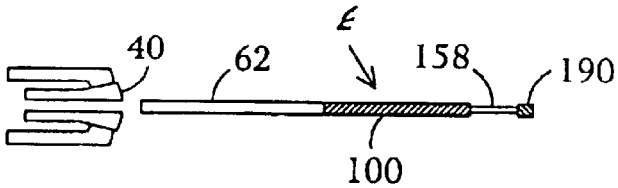

FIGS. 22 and 23 illustrate the completed or manufactured electrode E held by the first collet 40. The fifth collet 162 is indexed away from the first collet so that the complete electrode can be removed from the machine tool (see FIG. 24).

Figure 25:
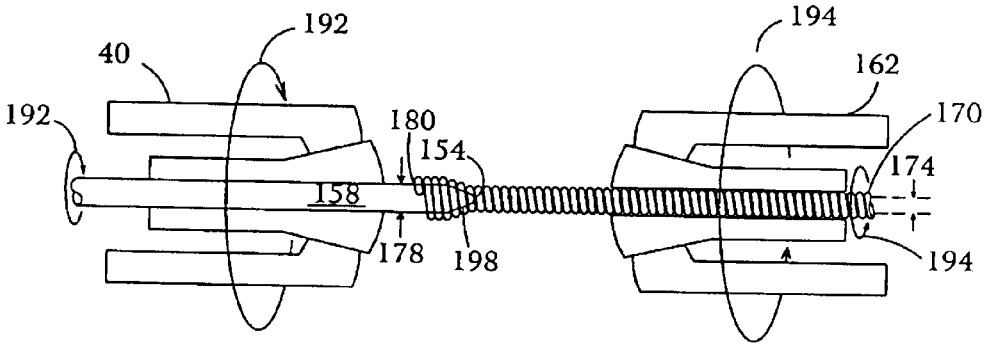
FIG. 25 is an enlarged elevation with selected components in partial cross-section showing engagement of a third material component and a coil facilitated by spinning and without the use of a guide.

FIG. 25 shows an alternative method of securing the tip onto the electrode to that described above with reference to FIGS. 18–22. Rotating or spinning at least one of the third material component 158 and the coil 170 during the securement or engagement process aids in assembly. At least one of the components is rotated in a direction represented by arrows 192, 194 so as to provide a force directed to unwinding or opening the coil 170. For example, the coil 170 is held stationary by the fifth collet 162 and the third material component is spun by the first collet 40 in a direction opposite the helical lay of the coil 170 (as indicated by direction arrow 192). As the inner surface of first end 180 of coil 170 makes contact with the outer surface of the third component material 158 an unwinding or opening frictional force is applied to the inner surface of the coil 170. This force tends to open the coil 170 facilitating further engagement. When the two components are mated the predetermined engagement distance 186 (see FIG. 20), rotation is terminated.

As no ted above, the inner diameter 174 of the unmated coil is less than the outer diameter 178 of the third material component 158. Additionally, the coil is made of material with spring-like characteristics. Therefore, when complete, the electrode tip component 190 (see FIG. 22) returns to its original diameter and tightly grips the outer diameter of the third material component. Thus, the two components 158, 190 are press fit together.

The process may be further aided by forming a taper 198 in the second the end 154 of the third material component 158. Tapering can be accomplished with an added grinding, hot neck-down, or other appropriate tip shaping step ( not shown). The taper provides a locating or centering feature of the third material component into the coil so that the helix is progressively opened as it axially advances thereover.

The invention has been described with reference to a preferred embodiment. Obviously modifications and alterations will occur to others upon reading and understanding this specification. For example, the electrode can be made in the reverse order from that described. The third material component and coil portion can be manufactured separately and placed in the collet with another mechanism. Likewise, fewer than all of the described components can be used to make the electrode or additional components can be included. Alternatively, the coil can be plasma or resistance welded to the third material component to further strengthen its adhesion. Moreover, although the process steps are illustrated as being conducted in a horizontal direction, the orientation is not critical to practice of the invention. While the described embodiment makes use of a plurality of collets, it is understood that other embodiments may use two or fewer collets. The invention is intended to include all such modifications and alterations insofar as they come within the scope of the appended claims and equivalents thereof.

What is claimed is:

1. A method for making a lamp electrode comprising:

cutting a first material to a desired length to define a first material component having a first end and a second end;

joining a first and of a second material to the second and of the first material component;

cutting the second material after joining the first and of the second material to define a second material component having a second end;

joining a first and of a third material to the second end of the second material;

cutting the third material to define a third material component having a second end, and securing a coil to the second end of the third material component.

2. The method for making a lamp electrode of claim 1 wherein the step of cutting a first material further comprises:

using a first collet to hold a first portion of the first material;

using a second collet to hold a second portion of the first material spaced from the first portion, and cutting the first material at a point between the first and second collets.

3. The method for making a lamp electrode of claim 1 wherein the step of joining a first end of a second material further comprises:

using a first collet to hold the first material component; and using a second collet to hold the second material so that the first end of the second material is located adjacent to the second end of the first material.

4. The method for making a lamp electrode of claim 1 wherein the step of cutting the second material further comprises:

using a first collet to hold a portion of at least one of the first and second material components;

using a second collet to hold a portion of the second material, and cutting the second material at a point between the first and second collets.

5. The method for making a lamp electrode of claim 1 wherein the step of joining a first end of a third material further comprises;

using a first collet to hold at least one of the first and second material components, and using a second collet to hold the third material adjacent to the second end of the second material.

6. The method for making a lamp electrode of claim 1 wherein the step of cutting the third material further comprises:

using a first collet to hold a portion of at least one of the first material component, the second material component, and a first portion of the third material;

using a second collet to hold a second portion of the third material, and cutting the third material at a point between the first and second collets.

7. The method for making a lamp electrode of claim 1 wherein the cutting steps further comprise:

cutting with a high speed diamond saw.

8. The method for making a lamp electrode of claim 1 wherein the steps of joining further comprise welding.

9. The method for making a lamp electrode of claim 1 wherein the step of cutting a first material further comprises the step of:

supplying a niobium wire to be cut.

10. The method for making a lamp electrode of claim 1 wherein the step of joining a first end of a second material further comprises the step of:

supplying a molybdenum overwind to be joined.

11. The method for making a lamp electrode of claim 1 wherein the step of joining a first end of a third material further comprises the step of:

supplying a tungsten wire to be joined.

12. The method for making a lamp electrode of claim 1 wherein the step of joining a first end of a second material is performed subsequent to the step of cutting a first material.

13. The method for making a lamp electrode of claim 1 wherein the step of cutting the second material is performed subsequent to the step of joining of first end of the second material.

14. The method for making a lamp electrode of claim 1 wherein the step of joining a first end of a third material is performed subsequent to the step of cutting the second material.

15. The method for making a lamp electrode of claim 1 wherein the step of cutting the third material is performed subsequent to the step of joining a first end of a third material.

16. The method for making a lamp electrode of claim 1 wherein the step of securing a coil is performed subsequent to the step of cutting the third material.

17. A method for making a lamp electrode comprising:

cutting a first material to a desired length to define a first material component having a first end and a second end;

joining a first end of a second material to the second end of the first material component;

cutting the second material to define a second material component having a second end;

joining a first end of a third material to the second end of the second material;

cutting the third material to define a third material component having a second end;

securing a coil to the second end of the third material component including pushing the coil over an end of the third material component; and cutting through the coil and a portion of the third material component in order to use the third material component as a support during the cutting process.

18. A method for making an electrode for a lamp comprising the steps of:

axially aligning a first collet and a second collet in facing relation;

positioning a first material in the second collet with the leading-edge of the first material at a reference position;

advancing the first material a first distance into the first collet;

cutting the first material whereby a first material component is held in the first collet;

replacing the second collet with a third collet, the third collet containing a second material;

locating the second material adjacent to the first material;

welding the second material to the first material;

advancing the welded materials further through the first collet;

cutting the second material at a second material cutting position between the first and third collets defining a second material component having a second end;

replacing the third collet with a fourth collet, the fourth collet containing a third material;

locating the third material adjacent to the second end of the second material component;

welding the third material to the second end of the second material component;

advancing the welded materials further through the first collet;

cutting the third material at a third material cutting position between the first and fourth collets, defining third material component and a second end of the third material component;

replacing the fourth collet with the fifth collet, the fifth collet containing a coil;

securing the coil to the fourth stage electrode assembly, and cutting the coil at a coil cutting position.

19. The method for making an electrode for a lamp of claim 18 wherein the step of securing further comprises:

pushing the coil over an and of the third material component.

20. The method for making an electrode for a lamp of claim 18 wherein the step of securing further comprises:

selecting a cool having an inner diameter that is smaller than an outer diameter of the third material component.

21. The method for making an electrode for a lamp of claim 18 wherein the step of securing further comprises:

rotating at least one of the coil and the third material component for causing the coil to open as it is pushed over the end of the third material component.

22. The method for making an electrode for a lamp of claim 18 wherein the step of securing further comprises:

press-fitting the coil to the second end of the third material component.

23. The method for making an electrode for a lamp of claim 18 wherein the step of securing further comprises:

fusing the coil to the second end of the third material component.

* * * * *